US005891831A

United States Patent [19]

Matsuya et al.

[11] Patent Number: 5,891,831

[45] Date of Patent: Apr. 6, 1999

[54] VISCOSITY INDEX IMPROVER, ENGINE LUBRICANT COMPOSITION, AND CONCENTRATE

[75] Inventors: Hidehiko Matsuya; Koji Takeuchi, both of Kyoto, Japan

[73] Assignee: Sanyo Chemical Industries, Ltd., Kyoto, Japan

[21] Appl. No.: 802,095

[22] Filed: Feb. 19, 1997

[30] Foreign Application Priority Data

Feb. 20, 1996 [JP] Japan ..... 8-58496
Mar. 28, 1996 [JP] Japan ..... 8-104026

[51] Int. Cl.[6] ..... C10M 145/14

[52] U.S. Cl. ..... 508/472; 526/320; 526/329.1; 526/329.6; 526/329.7; 562/285

[58] Field of Search ..... 508/472; 526/320, 526/329.1, 329.6, 329.7, 285

[56] References Cited

U.S. PATENT DOCUMENTS

| | | | |
|---|---|---|---|
| 2,218,362 | 10/1940 | Starkweather et al. | 526/329.1 |
| 2,380,304 | 7/1945 | Gleason | 508/472 |
| 2,628,225 | 2/1953 | Tutwiler et al. . | |
| 2,994,663 | 8/1961 | Lowe et al. | 508/472 |
| 3,198,854 | 8/1965 | Warner | 526/329.1 |
| 4,371,676 | 2/1983 | Hoene | 526/285 |
| 4,533,482 | 8/1985 | Bollinger | 508/472 |
| 4,656,219 | 4/1987 | Oyama et al. | 526/329.1 |
| 4,756,843 | 7/1988 | Jarrin et al. | 508/472 |
| 5,002,676 | 3/1991 | Willis et al. | 508/472 |
| 5,229,021 | 7/1993 | Pillon et al. . | |

FOREIGN PATENT DOCUMENTS

| | | |
|---|---|---|
| 54-70305 | 6/1979 | Japan . |
| 1112749 | 5/1968 | United Kingdom . |

OTHER PUBLICATIONS

Karzhaubaeva, R.G, Copolymerization of phenyacetylene with some alkyl methacrylates. Tr. Inst. Khim. Nauk, Akad. Nauk KaZ. SSR, 28, 115–17 (Russian) 1970.

C.V. Smallheer, Lubricant Additives, Lezius–Hiles Co. Cleveland, Ohio (1967).

*Primary Examiner*—C. H. Kelly
*Assistant Examiner*—Cephia D. Toomer
*Attorney, Agent, or Firm*—Nikaido, Marmelstein, Murray & Oram LLP

[57] ABSTRACT

Disclosed are a viscosity index improver which comprises a copolymer (A) consisting essentially of an alkyl methacrylate (a1), and one or more monomers (a2) selected from the group of conjugated dienes, acetylene, substituted acetylene, alkyl vinyl ethers and alkyl allyl ethers; an engine lubricant composition comprising said viscosity index improver and base oil; and a concentrate comprising an increased amount of said viscosity index improver and base oil. The viscosity index improver gives reduced amounts of coked products, while improving the fuel-related performance characteristics of cars that use the engine lubricant composition comprising the improver.

14 Claims, No Drawings

VISCOSITY INDEX IMPROVER, ENGINE LUBRICANT COMPOSITION, AND CONCENTRATE

BACKGROUND OF THE INVENTION

1. Field of the Invention

The present invention relates to a viscosity index improver, an engine lubricant composition, and a concentrate. More precisely, it relates to a viscosity index improver producing reduced amounts of coked products, an engine lubricant composition comprising said viscosity index improver and base oil, and a concentrate comprising an increased amount of said viscosity index improver and base oil.

2. Description of the Prior Art

With the recent tendency toward the global environmental protection, there is being an increased demand for much more improvements in fuel-related performance characteristics of cars (fuel consumption in cars). As one means of improving such fuel-related performance characteristics of cars, so-called multi-grade oil comprising engine oil and a viscosity index improver may be used. At present, about 30% of engine oil to be used in diesel engine cars in Japan will be such multi-grade oil. Multi-grade oil of the type generally contains a viscosity index improver comprising an ethylene-propylene copolymer (hereinafter referred to as "OCP viscosity index improver").

Where further improvements are required in fuel-related performance characteristics of cars in future, engine oil to be used will be required to have a reduced viscosity. In order to satisfy this requirement, engine oil must have a high viscosity index while having a lowered high-temperature high-shear viscosity (that is, a lowered TBS viscosity).

However, engine oil containing such an OCP viscosity index improver added thereto is defective in that its viscosity index is low while its high-temperature high-shear viscosity is high, thereby resulting in that the engine oil containing it is problematic in that its viscosity could not be lowered any more and that fuel-related performance characteristics of cars that use it could not be improved any more.

In order to solve these problems, the addition of a viscosity index improver containing an alkyl methacrylate polymer (hereinafter referred to as "PMA viscosity index improver") to engine oil may be taken into consideration. Since engine oil containing such a PMA viscosity index improver may have a higher viscosity index and a lower TBS viscosity than that containing an OCP viscosity index improver, it is expected that the former may have a lowered viscosity and that fuel-related performance characteristics of cars that use the former could be much more improved.

However, engine oil containing a PMA viscosity index improver is problematic in its practical use in that it gives large amounts of coked products.

SUMMARY OF THE INVENTION

We, the present inventors have assiduously studied and have found out a novel PMA viscosity index improver, which, when added to engine lubricant composition, gives coked products of almost the same level as or smaller than those to be given by engine lubricant composition containing an OCP viscosity index improver added thereto. On the basis of this finding, we have completed the present invention.

One object of the present invention is to provide a PMA viscosity index improver, which, when added to engine lubricant composition, gives coked products of almost the same level as or smaller than those to be given by engine lubricant composition containing a conventional OCP viscosity index improver added thereto, and which can much more improve fuel-related performance characteristics of cars that use such an engine lubricant composition containing it, and also provide an engine lubricant composition containing said PMA viscosity index improver, and a concentrate containing an increased amount of said PMA viscosity index improver.

The above-mentioned object and other objects of the present invention will be further clarified by the following description, and these objects can be attained by the following constitution of the invention.

Specifically, the viscosity index improver of the present invention comprises a copolymer (A) consisting essentially of (1) an alkyl methacrylate (a1), and (2) one or more monomers (a2) selected from the group consisting of conjugated dienes, acetylene, substituted acetylenes, alkyl vinyl ethers and alkyl allyl ethers.

The conjugated dienes may include butadiene and isoprene; the substituted acetylenes may include phenylacetylene; and the alkyl vinyl ethers and alkyl allyl ethers may have an alkyl group with from 1 to 8 carbon atoms.

The engine lubricant composition of the present invention comprises the above-mentioned viscosity index improver and base oil; and the concentrate of the invention comprises an increased amount of said viscosity index improver and base oil.

DETAILED DESCRIPTION OF PREFERRED EMBODIMENTS OF THE INVENTION

The viscosity index improver of the present invention comprises a copolymer (A) consisting essentially of an alkyl methacrylate (a1) and one or more monomers (a2).

The amount of the alkyl methacrylate (a1) that constitutes the copolymer (A) may be generally from 30 to 99.99% by weight, preferably from 40 to 99.0% by weight, relative to the weight of the copolymer (A), as giving reduced amounts of coked products.

The alkyl methacrylate (a1) may generally include methacrylates with a linear or branched alkyl group having from 1 to 22 carbon atoms (for example, methyl methacrylate, ethyl methacrylate, butyl methacrylate, 2-ethylhexyl methacrylate, decyl methacrylate, dodecyl methacrylate, tridecyl methacrylate, tetradecyl methacrylate, pentadecyl methacrylate, hexadecyl methacrylate, octadecyl methacrylate). Of these, preferred are alkyl methacrylates in which the alkyl moiety has from 1 to 10 carbon atoms. Especially preferred are combinations of an alkyl methacrylate in which the alkyl moiety has from 1 to 4 carbon atoms, and an alkyl methacrylate in which the alkyl moiety has from 8 to 10 carbon atoms. In the combinations of such alkyl methacrylates, the ratio by weight of the alkyl methacrylate in which the alkyl moiety has from 1 to 4 carbon atoms to the alkyl methacrylate in which the alkyl moiety has from 8 to 10 carbon atoms may be generally from 3:97 to 20:80, preferably from 5:95 to 15:85.

The monomer (a2) is one or more to be selected from the group consisting of conjugated dienes, acetylene, substituted acetylene, alkyl vinyl ethers and alkyl allyl ethers. The amount of the monomer (a2) that constitutes the copolymer (A) may be generally from 0.01 to 10% by weight, preferably from 0.1 to 5% by weight, relative to the weight of the copolymer (A), as giving reduced amounts of coked products and ensuring the oxidation-resistant stability of the copolymer (A).

The conjugated dienes to be selectable for the monomer (a2) may include, for example, butadiene, isoprene and chloroprene. Of these, preferred are butadiene and isoprene.

The substituted acetylenes to be selectable for the monomer (a2) may include, for example, alkylacetylenes such as propyne, 1-butyne, 1-pentyne and 1-hexyne; and arylacetylenes such as phenylacetylene and p-methylphenylacetylene. Of these, preferred are arylacetylenes.

The alkyl vinyl ethers to be selectable for the monomer (a2) may include, in general, alkyl vinyl ethers having a linear or branched alkyl group with from 1 to 18 carbon atoms (for example, methyl vinyl ether, ethyl vinyl ether, propyl vinyl ether, butyl vinyl ether, amyl vinyl ether, hexyl vinyl ether, heptyl vinyl ether, octyl vinyl ether, nonyl vinyl ether, decyl vinyl ether, dodecyl vinyl ether, tridecyl vinyl ether, tetradecyl vinyl ether, pentadecyl vinyl ether, hexadecyl vinyl ether, octadecyl vinyl ether). Of these, preferred are alkyl vinyl ethers in which the alkyl moiety has from 1 to 8 carbon atoms.

The alkyl allyl ethers to be selectable for the monomer (a2) may include, in general, alkyl allyl ethers having a linear or branched alkyl group with from 1 to 18 carbon atoms (for example, methyl allyl ether, ethyl allyl ether, propyl allyl ether, butyl allyl ether, amyl allyl ether, hexyl allyl ether, heptyl allyl ether, octyl allyl ether, nonyl allyl ether, decyl allyl ether, dodecyl allyl ether, tridecyl allyl ether, tetradecyl allyl ether, pentadecyl allyl ether, hexadecyl allyl ether, octadecyl allyl ether). Of these, preferred are alkyl allyl ethers in which the alkyl moiety has from 1 to 8 carbon atoms.

The copolymer (A) of the present invention may comprise any other radical-polymerizing monomer (b) as an additional constitutive component, in addition to the alkyl methacrylate (a1) and the monomer (a2). The radical-polymerizing monomer (b) may be a monomer composed of carbon and hydrogen atoms, or a monomer composed of carbon, hydrogen and oxygen atoms. The amount of the radical-polymerizing monomer (b) that may optionally constitute the copolymer (A) may be generally 70% by weight or lower, preferably 60% by weight or lower, relative to the weight of the copolymer (A). If the amount of the radical-polymerizing monomer (b) is more than 70% by weight, such will result in the production of increased amounts of coked products.

The radical-polymerizing monomer (b) may include, for example, the following:

(1) alkyl acrylates having an alkyl group with from 1 to 22 carbon atoms (e.g., methyl acrylate, ethyl acrylate, butyl acrylate, 2-ethylhexyl acrylate, decyl acrylate, isodecyl acrylate, dodecyl acrylate, tridecyl acrylate, tetradecyl acrylate, hexadecyl acrylate, octadecyl acrylate);

(2) unsaturated, mono- or poly-carboxylates in which the alkyl moiety has from 1 to 30 carbon atoms (e.g., butyl crotonate, octyl crotonate, dodecyl crotonate, dibutyl maleate, dioctyl fumarate, dilauryl maleate, distearyl fumarate, dioctyl itaconate, dilauryl itaconate);

(3) aromatic vinyl compounds (e.g., styrene, vinyltoluene);

(4) vinyl esters (e.g., vinyl acetate, vinyl propionate);

(5) alpha-olefins (e.g., decene, dodecene);

(6) carboxylic acids (e.g., maleic anhydride, methacrylic acid, crotonic acid, itaconic acid); and (7) acrolein.

Of these, preferred are alkyl acrylates having an alkyl group with from 1 to 22 carbon atoms, and aromatic vinyl compounds. Especially preferred are butyl acrylate, 2-ethylhexyl acrylate and styrene.

The copolymer (A) of the present invention may further comprise, if desired, one or more monomers (c) having one or more atoms selected from nitrogen and sulfur atoms, as still additional constitutive components. The copolymer (A) thus containing such monomers (c) is preferred in that the monomers (c) may make the viscosity index improver comprising the copolymer (A) of the invention have the properties of clearing engine lubricant composition containing the improver, make the improver well dispersible in engine lubricant composition, and make the improver antioxidative. The amount of the monomers (c) that may optionally constitute the copolymer (A) may be generally 20% by weight or lower, preferably 10% by weight or lower,relative to the weight of the copolymer (A).

If the amount of the monomers (c) is more than 20% by weight, such will result in the production of increased amounts of coked products.

The monomers (c) may include, for example, N-vinylpyrrolidone, N-vinylthiopyrrolidone, vinylpyridine, N,N-dialkylaminoalkyl (meth)acrylates (in which the alkyl moiety may generally have from 1 to 4 carbon atoms), N,N-dialkylaminoalkyl(meth)acrylamides (in which the alkyl moiety may generally have from 1 to 4 carbon atoms), vinylimidazole, morpholinoalkylene (meth)acrylates, and (meth)acrylate derivatives having an aminophenothiazine, N-arylphenylenediamine, aminocarbazole, aminothiazole, aminoindole, aminopyrrole, aminoimidazoline, aminomercaptothiazole or aminopiperidine residue. Of these, preferred are N-vinylpyrrolidone, N,N-dialkylaminoalkyl (meth)acrylates (in which the alkyl moiety may generally have from 1 to 4 carbon atoms), N,N-dialkylaminoalkyl (meth)acrylamides (in which the alkyl moiety may generally have from 1 to 4 carbon atoms), and (meth)acrylate derivatives having an N-arylphenylenediamine residue.

The copolymer (A) can be produced easily according to any conventional methods, as in the manner mentioned below. For example, monomers (a1), (a2), (b) and (c) such as those mentioned hereinabove may be radical-polymerized in mineral oil or solvent to give copolymers (A). The polymerization catalyst employable in this case may include, for example, azo compounds (e.g., azobisisobutyronitrile, azobisvaleronitrile), and peroxides (e.g., benzoyl peroxide,cumyl peroxide, lauryl peroxide).

An alkyl methacrylate (a1) and a monomer (a2) may be polymerized optionally along with a radical-polymerizing monomer (b) and/or a monomer (c) to give a polymer, which may be further graft-polymerized with monomers (c) in the presence of a peroxide catalyst such as that mentioned hereinabove to obtain copolymers (A).

An alkyl methacrylate (a1) and a monomer (a2) may be polymerized optionally along with a radical-polymerizing monomer (b) and/or a monomer (c) to give a polymer, which may be modified through graft addition with any non-vinylic compounds (e.g., phenothiazines, imidazoles, thiazoles, benzothiazoles, triazoles, thiazolidines, pyrimidines, piperazines, pyrrolidinones, oxazoles, thiomorpholines) in the presence of a peroxide catalyst such as that mentioned hereinabove to obtain copolymers (A).

An alkyl methacrylate (a1), a monomer (a2) and a radical-polymerizing monomer (b) of being a carboxylic acid compound (e.g., maleic anhydride, methacrylic acid, crotonic acid, itaconic acid) may be copolymerized to give a copolymer, which may be modified through amidation or imidation with (poly)amines to obtain copolymers (A). An alkyl methacrylate (a1), a monomer (a2) and a radical-polymerizing monomer (b) of acrolein may be copolymerized to give a copolymer, which may be modified through Mannich condensation with (poly)amines to obtain copolymers (A).

The copolymer (A) may have a weight average molecular weight (Mw) of generally from 10,000 to 500,000, preferably from 130,000 to 500,000, in view of its viscosity-increasing effect and its shear stability. The weight average molecular weight as referred to herein is one as measured through gel permeation chromatography in terms of polystyrene.

It is preferable that the weight average molecular weight (Mw1) of the copolymer (A) as measured after having been heated in air at 220° C. for 10 minutes, and the weight average molecular weight (Mw) of the non-heated copolymer (A) satisfy the following equation (1), as giving reduced amounts of coked products.

$$Mw1/Mw \leqq 0.7 \quad (1)$$

The viscosity index improver of the present invention preferably contains a pour point depressant (B), of which the content may be generally 30 parts by weight or smaller, preferably from 1 to 20 parts by weight, relative to 100 parts by weight of the copolymer (A).

The pour point depressant (B) may be any known one, including, for example, polymethacrylates. For examples, usable are polymethacrylates in which the alkyl moiety has from 10 to 20 carbon atoms, combinations of two or more different such polymethacrylates each having a different composition and a different molecular weight (e.g., those described in Japanese Patent Application Laid-Open No. 54-70305), and even polymethacrylates having an extremely large molecular weight (e.g., those described in U.S. Pat. No. 5,229,021).

The viscosity index improver of the present invention may further contain any other optional components, such as detergents (e.g., sulfonates, salicylates, phenates, napthenates), dispersants (e.g., isobutenylsuccinimides, Mannich condensates), antioxidants (e.g., zinc dithiophosphates, amines, hindered phenols), oils (e.g., fatty acids, fatty acid esters), friction and abrasion controllers (e.g., molybdenum dithiophosphates, molybdenum carbamates), extreme-pressure lubricants (e.g., sulfur-containing phosphorus compounds, chlorine-containing compounds).

The engine lubricant composition of the present invention comprises the viscosity index improver of the invention and base oil. The base oil for the engine lubricant composition may be any one falling between 50 neutral oil and 300 neutral oil with respect to the viscosity range. Specific examples of the base oil may include ordinary mineral oil, synthetic oil (including synthetic lubricants, for example, hydrocarbons such as decene oligomers; esters such as typically esters of fatty acids with alcohols, e.g., trimethylolpropane, pentaerythritol and hexamethylenediol, and esters of adipic acid with aliphatic alcohols), and oil as produced through a so-called mobile lube dewaxing process (concretely, MLDW oil as produced through dewaxing with a synthetic zeolite catalyst or the like). The amount of the viscosity index improver to be added to the base oil may be generally from 1 to 30% by weight, preferably from 1 to 10% by weight, based on the practical concentration of the base oil.

The concentrate of the present invention differs from the above-mentioned engine lubricant composition of the invention in that the concentration of the viscosity index improver to be in the former is higher than that to be in the latter. After having been diluted, this concentrate shall have a concentration of the viscosity index improver falling within the above-mentioned practical concentration range. To prepare the concentrate of the type, the amount of the viscosity index improver to be therein may be generally from 10 to 95% by weight, preferably from 30 to 95% by weight, relative to the base oil.

The present invention will be understood much more clearly with reference to the following examples that embody the invention and to the following comparative examples that are compared with such examples, but these examples and comparative examples are to clarify the present invention but are not to restrict it.

EXAMPLE 1

Mineral oil of 150 g, and monomers, methyl methacrylate of 10 g, isodecyl methacrylate of 10 g, dodecyl methacrylate/tridecyl methacrylate mixture (produced from DOBANOL hereinafter referred to as 12/13 MA) of 35 g, tetradecyl methacrylate/pentadecyl methacrylate mixture (produced from Dobanol; hereinafter referred to as 14/15 MA) of 35 g and isoprene of 0.5 g, and a catalyst, azobisvaleronitrile of 0.2 g were put into a reactor equipped with a stirrer, a heater, a thermometer and a nitrogen-bubbling duct, which was then substituted with nitrogen gas and sealed. Then, these were polymerized in the closed system at 70° C. for 4 hours to give a viscosity index improver of the invention comprising a copolymer The copolymer produced herein was heated in air at 220° C. for 10 minutes, and its weight average molecular weight (Mw1) was 170,000, with Mw1/Mw=0.57.

EXAMPLE 2

The same process as in Example 1 was repeated, except that one monomer, 0.5 g of isoprene was replaced by 0.5 g of butadiene. Thus herein obtained was a viscosity index improver of the invention comprising a copolymer having a weight average molecular weight (Mw) of 310,000. After having been heated in the same manner as in Example 1, the copolymer had a weight average molecular weight (Mw1) of 180,000, with Mw1/Mw=0.58.

EXAMPLE 3

The same process as in Example 1 was repeated, except that one monomer, 0.5 g of isoprene was replaced by 0.5 g of phenylacetylene. Thus herein obtained was a viscosity index improver of the invention comprising a copolymer having a weight average molecular weight (Mw) of 290,000. After having been heated in the same manner as in Example 1, the copolymer had a weight average molecular weight (Mw1) of 180,000, with Mw1/Mw=0.62.

EXAMPLE 4

The same process as in Example 1 was repeated, except that monomers, methyl methacrylate of 10 g, 2-ethylhexyl methacrylate of 45 g, isodecyl methacrylate of 45 g and isoprene of 0.5 g were used. Thus obtained herein was a viscosity index improver of the invention comprising a copolymer having a weight average molecular weight (Mw) of 270,000. After having been heated in the same manner as in Example 1, the copolymer had a weight average molecular weight (Mw1) of 140,000, with Mw1/Mw=0.52.

EXAMPLE 5

The same process as in Example 1 was repeated, except that monomers, butyl methacrylate of 10 g, 2-ethylhexyl methacrylate of 45 g, isodecyl methacrylate of 45 g and isoprene of 0.5 g were used. Thus obtained herein was a viscosity index improver of the invention comprising a copolymer having a weight average molecular weight (Mw) of 270,000. After having been heated in the same manner as in Example 1, the copolymer had a weight average molecular weight (Mw1) of 140,000, with Mw1/Mw=0.52.

EXAMPLE 6

The same process as in Example 1 was repeated, except that monomers, methyl methacrylate of 10 g, 2-ethylhexyl methacrylate of 90 g and isoprene of 0.5 g were used. Thus obtained herein was a viscosity index improver of the invention comprising a copolymer having a weight average molecular weight (Mw) of 340,000. After having been heated in the same manner as in Example 1, the copolymer had a weight average molecular weight (Mw1) of 160,000, with Mw1/Mw=0.47.

EXAMPLE 7

The same process as in Example 1 was repeated, except that monomers, methyl methacrylate of 10 g, 2-ethylhexyl methacrylate of 45 g, 2-ethylhexyl acrylate of 45 g and isoprene of 0.5 g were used. Thus obtained herein was a viscosity index improver of the invention comprising a copolymer having a weight average molecular weight (Mw) of 280,000. After having been heated in the same manner as in Example 1, the copolymer had a weight average molecular weight (Mw1) of 180,000, with Mw1/Mw=0.64.

EXAMPLE 8

The same process as in Example 1 was repeated, except that monomers, methyl methacrylate of 5 g, 2-ethylhexyl methacrylate of 45 g, 2-ethylhexyl acrylate of 45 g, butyl acrylate of 5 g and isoprene of 0.5 g were used. Thus obtained herein was a viscosity index improver of the invention comprising a copolymer having a weight average molecular weight (Mw) of 260,000. After having been heated in the same manner as in Example 1, the copolymer had a weight average molecular weight (Mw1) of 170,000, with Mw1/Mw=0.65.

EXAMPLE 9

The same process as in Example 1 was repeated, except that monomers, methyl methacrylate of 10 g, isodecyl methacrylate of 10 g, 12/13 MA of 35 g, 14/15 MA of 35 g, 2-ethylhexyl acrylate of 10 g and isoprene of 0.5 g were used. Thus obtained herein was a viscosity index improver of the invention comprising a copolymer having a weight average molecular weight (Mw) of 360,000. After having been heated in the same manner as in Example 1, the copolymer had a weight average molecular weight (Mw1) of 220,000, with Mw1/Mw=0.61.

EXAMPLE 10

The same process as in Example 1 was repeated, except that monomers, methyl methacrylate of 10 g, 14/15 MA of 40 g, 2-ethylhexyl acrylate of 50 g, N-(4-anilinophenyl) methacrylamide of 2 g and isoprene of 0.5 g were used. Thus obtained herein was a viscosity index improver of the invention comprising a copolymer having a weight average molecular weight (Mw) of 330,000. After having been heated in the same manner as in Example 1, the copolymer had a weight average molecular weight (Mw1) of 220,000, with Mw1/Mw=0.67.

EXAMPLE 11

Mineral oil of 150 g, and monomers, methyl methacrylate of 10 g, 14/15 MA of 40 g, 2-ethylhexyl acrylate of 50 g and isoprene of 0.5 g, and a catalyst, azobisvaleronitrile of 0.2 g were put into a reactor equipped with a stirrer, a heater, a thermometer and a nitrogen-bubbling duct, which was then substituted with nitrogen gas and sealed. Then, these were polymerized in the closed system at 70° C. for 4 hours. Next, 0.2 g of t-butyl perbenzoate and 2 g of N-vinylpyrrolidone were added thereto and graft-polymerized at 130° C. for 2 hours. Thus was obtained herein a viscosity index improver of the invention comprising a copolymer having a weight average molecular weight (Mw) of 320,000. After having been heated in the same manner as in Example 1, the copolymer hada weight average molecular weight (Mw1) of 210,000, with Mw1/Mw=0.66.

EXAMPLE 12

The same process as in Example 1 was repeated, except that monomers, methyl methacrylate of 10 g, isodecyl methacrylate of 10 g, 12/13 MA of 40 g, 14/15 MA of 40 g and n-propyl vinyl ether of 0.5 g were used. Thus obtained herein was a viscosity index improver of the invention comprising a copolymer having a weight average molecular weight (Mw) of 310,000. After having been heated in the same manner as in Example 1, the copolymer had a weight average molecular weight (Mw1) of 180,000, with Mw1/Mw=0.58.

EXAMPLE 13

The same process as in Example 12 was repeated, except that one monomer, 0.5 g of n-propyl vinyl ether was replaced by 0.5 g of isobutyl vinyl ether. Thus herein obtained was a viscosity index improver of the invention comprising a copolymer having a weight average molecular weight (Mw) of 300,000. After having been heated in the same manner as in Example 1, the copolymer had a weight average molecular weight (Mw1) of 180,000, with Mw1/Mw=0.60.

EXAMPLE 14

The same process as in Example 12 was repeated, except that one monomer, 0.5 g of n-propyl vinyl ether was replaced by 0.5 g of ethyl vinyl ether. Thus herein obtained was a viscosity index improver of the invention comprising a copolymer having a weight average molecular weight (Mw) of 300,000. After having been heated in the same manner as in Example 1, the copolymer had a weight average molecular weight (Mw1) of 170,000, with Mw1/Mw=0.57.

EXAMPLE 15

The same process as in Example 12 was repeated, except that monomers, methyl methacrylate of 10 g, 2-ethylhexyl methacrylate of 45 g, isodecyl methacrylate of 45 g and n-propyl vinyl ether of 0.5 g were used. Thus obtained herein was a viscosity index improver of the invention comprising a copolymer having a weight average molecular weight (Mw) of 280,000. After having been heated in the same manner as in Example 1, the copolymer had a weight average molecular weight (Mw1) of 150,000, with Mw1/Mw=0.54.

EXAMPLE 16

The same process as in Example 12 was repeated, except that monomers, butyl methacrylate of 10 g, 2-ethylhexyl methacrylate of 45 g, isodecyl methacrylate of 45 g and n-propyl vinyl ether of 0.5 g were used. Thus obtained herein was a viscosity index improver of the invention comprising a copolymer having a weight average molecular weight (Mw) of 260,000. After having been heated in the same manner as in Example 1, the copolymer had a weight average molecular weight (Mw1) of 140,000, with Mw1/Mw=0.54.

EXAMPLE 17

The same process as in Example 12 was repeated, except that monomers, methyl methacrylate of 10 g, 2-ethylhexyl methacrylate of 90 g and n-propyl vinyl ether of 0.5 g were used. Thus obtained herein was a viscosity index improver of the invention comprising a copolymer having a weight average molecular weight (Mw) of 350,000. After having been heated in the same manner as in Example 1, the copolymer had a weight average molecular weight (Mw1) of 170,000, with Mw1/Mw=0.49.

EXAMPLE 18

The same process as in Example 12 was repeated, except that monomers, methyl methacrylate of 10 g, 2-ethylhexyl methacrylate of 45 g, 2-ethylhexyl acrylate of 45 g and n-propyl vinyl ether of 0.5 g were used. Thus obtained herein was a viscosity index improver of the invention comprising a copolymer having a weight average molecular weight (Mw) of 290,000. After having been heated in the same manner as in Example 1, the copolymer had a weight average molecular weight (Mw1) of 180,000, with Mw1/Mw=0.62.

EXAMPLE 19

The same process as in Example 12 was repeated, except that monomers, methyl methacrylate of 5 g, 2-ethylhexyl methacrylate of 45 g, 2-ethylhexyl acrylate of 45 g, butyl acrylate of 5 g and n-propyl vinyl ether of 0.5 g were used. Thus obtained herein was a viscosity index improver of the invention comprising a copolymer having a weight average molecular weight (Mw) of 270,000. After having been heated in the same manner as in Example 1, the copolymer had a weight average molecular weight (Mw1) of 170,000, with Mw1/Mw=0.63.

EXAMPLE 20

The same process as in Example 12 was repeated, except that monomers, methyl methacrylate of 10 g, 14/15 MA of 40 g, 2-ethylhexyl acrylate of 50 g, N-(4-anilinophenyl) methacrylamide of 2 g and n-propyl vinyl ether of 0.5 g were used. Thus obtained herein was a viscosity index improver of the invention comprising a copolymer having a weight average molecular weight (Mw) of 340,000. After having been heated in the same manner as in Example 1, the copolymer had a weight average molecular weight (Mw1) of 220,000, with Mw1/Mw=0.65.

EXAMPLE 21

The same process as in Example 11 was repeated, except that one monomer, 0.5 g of isoprene was replaced by 0.5 g of n-propyl vinyl ether. Thus herein obtained was a viscosity index improver of the invention comprising a copolymer having a weight average molecular weight (Mw) of 320,000. After having been heated in the same manner as in Example 1, the copolymer had a weight average molecular weight (Mw1) of 200,000, with Mw1/Mw=0.63.

EXAMPLE 22

The same process as in Example 12 was repeated, except that one monomer, 0.5 g of n-propyl vinyl ether was replaced by 0.5 g of n-propyl allyl ether. Thus herein obtained was a viscosity index improver of the invention comprising a copolymer having a weight average molecular weight (Mw) of 330,000. After having been heated in the same manner as in Example 1, the copolymer had a weight average molecular weight (Mw1) of 200,000, with Mw1/Mw=0.61.

EXAMPLE 23

The same process as in Example 12 was repeated, except that one monomer, 0.5 g of n-propyl vinyl ether was replaced by 0.5 g of isobutyl allyl ether. Thus herein obtained was a viscosity index improver of the invention comprising a copolymer having a weight average molecular weight (Mw) of 340,000. After having been heated in the same manner as in Example 1, the copolymer had a weight average molecular weight (Mw1) of 210,000, with Mw1/Mw=0.62.

Comparative Example 1

The same process as in Example 1 was repeated, except that 0.5 g of isoprene was not used. Thus herein obtained was a viscosity index improver comprising a copolymer with a weight average molecular weight (Mw) of 330,000. After having been heated in the same manner as in Example 1, the copolymer had a weight average molecular weight (Mw1) of 270,000, with Mw1/Mw=0.82.

Comparative Example 2

The same process as in Example 12 was repeated, except that 0.5 g of n-propyl vinyl ether was not used. Thus herein obtained was a viscosity index improver comprising a copolymer with a weight average molecular weight (Mw) of 320,000. After having been heated in the same manner as in Example 1, the copolymer had a weight average molecular weight (Mw1) of 270,000, with Mw1/Mw=0.84.

Comparative Example 3

An OCP viscosity index improver comprising an ethylene-propylene copolymer (Orpheus M-1210, produced by Mitsui Petro-Chemical Industry Co.) was prepared and used herein as a viscosity index improver of Comparative Example 3.

Use Examples 1 to 23, and Comparative Use Examples 1 to 3:

The viscosity index improvers of Examples 1 to 23 of the invention and Comparative Examples 1 to 3 were separately mixed with a DI package for CD-grade diesel engine lubricant composition, a solvent-refined oil A (150 neutral oil with a viscosity index of 100) and a solvent-refined oil B (200 neutral oil with a viscosity index of 100) to prepare various engine lubricant compositions of Use Examples 1 to 23 and Comparative Use Examples 1 to 3. The amount of the DI package added was 5% by weight relative to the weight of the engine lubricant composition, and the amount of the viscosity index improver to be added and the amounts of the solvent-refined oils A and B to be added were so controlled that the engine lubricant compositions might have a kinematic viscosity of 10.2 cSTs and a CCS viscosity at −20° C. of 3000 cPs. The amount of the viscosity index improver was varied within the range of from 4 to 5% by weight.

Next, the engine lubricant compositions thus prepared were subjected to the following panel coking test and oxidation-resistance test, while measuring their TBS viscosity (at 150° C. and a shear rate of $10^6$/sec) and viscosity index that have relation to the fuel-related performance characteristics of cars using the engine lubricant compositions. The data obtained are shown in Table 1 and Table 2.

Method of Panel Coking Test:

Each engine lubricant composition sample was subjected to a panel coking test according to Fed-791B, at a panel temperature of 300° C. and an engine lubricant composition temperature of 100° C. for 4 hours.

After the test, the panel was washed with pentane, and the amount of coked products formed thereon was measured in terms of the weight thereof.

Method of Oxidation-Resistace Test:

Each engine lubricant composition sample was subjected to an oxidation-resistance test according to JIS-K2514 at 165.5° C. for 96 hours. After the test, the increase in the total acid value of the sample tested was measured.

TABLE 1

| | | Viscosity Index Improver | | Amount of Coked Products Formed(mg) | Increase in Total Acid Value (mg KOH/g) |
|---|---|---|---|---|---|
| Use Example | 1 | Example | 1 | 76 | 2.2 |
| | 2 | | 2 | 75 | 2.3 |
| | 3 | | 3 | 78 | 2.5 |
| | 4 | | 4 | 65 | 2.0 |
| | 5 | | 5 | 60 | 2.4 |
| | 6 | | 6 | 66 | 2.3 |
| | 7 | | 7 | 76 | 2.4 |
| | 8 | | 8 | 78 | 2.8 |
| | 9 | | 9 | 68 | 2.6 |
| | 10 | | 10 | 65 | 1.0 |
| | 11 | | 11 | 70 | 1.5 |
| | 12 | | 12 | 74 | 2.1 |
| | 13 | | 13 | 73 | 2.2 |
| | 14 | | 14 | 77 | 2.2 |
| | 15 | | 15 | 64 | 1.8 |
| | 16 | | 16 | 61 | 2.2 |
| | 17 | | 17 | 65 | 2.4 |
| | 18 | | 18 | 74 | 2.2 |
| | 19 | | 19 | 77 | 2.7 |
| | 20 | | 20 | 78 | 0.8 |
| | 21 | | 21 | 77 | 2.5 |
| | 22 | | 22 | 73 | 2.3 |
| | 23 | | 23 | 72 | 2.4 |
| Comparative Use Example | 1 | Comparative Example | 1 | 180 | 2.0 |
| | 2 | | 2 | 180 | 2.0 |
| | 3 | | 3 | 85 | 2.8 |

As is known from Table 1, the engine lubricant compositions of Use Examples 1 to 23 of the present invention (each containing a viscosity index improver comprising "a methacrylate polymer with any of conjugated dienes, substituted acetylenes, alkyl vinyl ethers and alkyl allyl ethers") give much more reduced amounts of coked products than the engine lubricant compositions of Comparative Use Examples 1 and 2 (each containing a viscosity index improver comprising "a methacrylate polymer with none of conjugated dienes, substituted acetylenes, alkyl vinyl ethers and alkyl allyl ethers"), while giving coked products of almost the same level as or smaller than those to be given by the engine lubricant composition of Comparative Use Example 3 containing "an OCP viscosity index improver that has heretofore been said to give reduced amounts of coked products".

TABLE 2

| | | Viscosity Index Improver | | TBS Viscosity (mPa · s) | Viscosity Index |
|---|---|---|---|---|---|
| Use Example | 1 | Example | 1 | 2.99 | 181 |
| | 2 | | 2 | 3.01 | 180 |
| | 3 | | 3 | 3.00 | 179 |
| | 4 | | 4 | 3.01 | 178 |
| | 5 | | 5 | 3.03 | 174 |
| | 6 | | 6 | 3.02 | 178 |
| | 7 | | 7 | 2.92 | 173 |
| | 8 | | 8 | 2.93 | 174 |
| | 9 | | 9 | 3.02 | 176 |
| | 10 | | 10 | 2.94 | 178 |
| | 11 | | 11 | 2.93 | 176 |
| | 12 | | 12 | 2.98 | 182 |
| | 13 | | 13 | 3.00 | 181 |
| | 14 | | 14 | 3.01 | 178 |
| | 15 | | 15 | 3.02 | 179 |
| | 16 | | 16 | 3.04 | 175 |
| | 17 | | 17 | 3.03 | 177 |
| | 18 | | 18 | 2.93 | 174 |
| | 19 | | 19 | 2.92 | 173 |
| | 20 | | 20 | 2.93 | 175 |
| | 21 | | 21 | 2.92 | 174 |
| | 22 | | 22 | 2.98 | 181 |
| | 23 | | 23 | 2.97 | 182 |
| Comparative Use Example | 1 | Comparative Example | 1 | 3.00 | 180 |
| | 2 | | 2 | 2.99 | 180 |
| | 3 | | 3 | 3.11 | 150 |

As is known from Table 2, the engine lubricant compositions of Use Examples 1 to 23 each comprising the viscosity index improver of the present invention have a lower TBS viscosity and a higher viscosity index than the engine lubricant composition of Comparative Use Example 3 comprising an OCP viscosity index improver.

What is claimed is:

1. A viscosity index improver, which comprises a copolymer (A) consisting essentially of:

(1) 30 to 99.99% by weight, relative to the weight of the copolymer (A), of an alkyl methacrylate (a1);

(2) 0.01 to 10% by weight, relative to the weight of the copolymer (A), of one or more monomers (a2) selected from the group consisting of conjugated dienes, acetylene, substituted acetylene, alkyl vinyl ethers and alkyl allyl ethers;

(3) 0 to 70% by weight, relative to the weight of the copolymer (A), of a radical-polymerizing monomer (b) being a monomer composed of carbon and hydrogen atoms, or a monomer composed of carbon, hydrogen and oxygen atoms; and (4) 0 to 20% by weight, relative to the weight of the copolymer (A), of one or more monomers (c) having one or more atoms selected from nitrogen and sulfur atoms;

wherein the sum of the amounts of the alkyl methacrylate (a1), said one or more monomers (a2), the radical-polymerizing monomer (b) and said one or more monomers (c) is 100% by weight relative to the weight of the copolymer (A).

2. The viscosity index improver as claimed in claim 1, wherein the alkyl methacrylate (a1) has an alkyl group with from 1 to 10 carbon atoms.

3. The viscosity index improver as claimed in claim 1, wherein the alkyl methacrylate (a1) is a combination of an alkyl methacrylate in which the alkyl moiety has from 1 to 4 carbon atoms and an alkyl methacrylate in which the alkyl moiety has from 8 to 10 carbon atoms.

4. The viscosity index improver as claimed in claim 3, wherein the ratio by weight of the alkyl methacrylate in which the alkyl moiety has from 1 to 4 carbon atoms to the alkyl methacrylate in which the alkyl moiety has from 8 to 10 carbon atoms is from 3:97 to 20:80.

5. The viscosity index improver as claimed in claim 1, in which the copolymer (A) has a weight average molecular weight (Mw) of from 10,000 to 500,000.

6. The viscosity index improver as claimed in claim 1, in which the weight average molecular weight, Mw, of the copolymer (A) as measured prior to being heated and the weight average molecular weight, Mw1, of the copolymer (A) as measured after having been heated in air at 220° C. for 10 minutes satisfy the following equation (1):

$$Mw1/Mw \leqq 0.7 \quad (1)$$

7. The viscosity index improver as claimed in claim 1, wherein the conjugated diene is butadiene or isoprene.

8. The viscosity index improver as claimed in claim 1, wherein the substituted acetylene is phenylacetylene.

9. The viscosity index improver as claimed in claim 1, wherein the alkyl vinyl ether and alkyl allyl ether have an alkyl group with from 1 to 8 carbon atoms.

10. The viscosity index improver as claimed in claim 1, which further contains a pour point depressant (B) of from 1 to 20 parts by weight, relative to 100 parts by weight of the copolymer (A) therein.

11. An engine lubricant composition comprising a viscosity index improver and base oil, wherein the content of the viscosity index improver is from 1 to 30% by weight relative to the base oil therein and the viscosity index improver comprises a copolymer (A) consisting essentially of:

(1) 30 to 99.99% by weight, relative to the weight of the copolymer (A), of an alkyl methacrylate (a1);

(2) 0.01 to 10% by weight, relative to the weight of the copolymer (A), of one or more monomers (a2) selected from the group consisting of conjugated dienes, acetylene, substituted acetylene, alkyl vinyl ethers and alkyl allyl ethers;

(3) 0 to 70% by weight, relative to the weight of the copolymer (A), of a radical-polymerizing monomer (b) being a monomer composed of carbon and hydrogen atoms, or a monomer composed of carbon, hydrogen and oxygen atoms; and (4) 0 to 20% by weight, relative to the weight of the copolymer (A), of one or more monomers (c) having one or more atoms selected from nitrogen and sulfur atoms;

wherein the sum of the amounts of the alkyl methacrylate (a1), said one or more monomers (a2), the radical-polymerizing monomer (b) and said one or more monomers (c) is 100% by weight, relative to the weight of the copolymer (A).

12. The engine lubricant composition as claimed in claim 11, wherein the base oil is a mineral oil or a synthetic lubricant.

13. The engine lubricant composition as claimed in claim 11, wherein the base oil is an MLDW oil.

14. A concentrate comprising a viscosity index improver of claim 1 and base oil, wherein the content of the viscosity index improver is from 10 to 95% by weight relative to the base oil therein.

* * * * *